US008893809B2

(12) United States Patent
Charles et al.

(10) Patent No.: US 8,893,809 B2
(45) Date of Patent: Nov. 25, 2014

(54) FLOW CONTROL DEVICE WITH ONE OR MORE RETRIEVABLE ELEMENTS AND RELATED METHODS

(75) Inventors: Jack E. Charles, Kuala Lumpur (MY); Benn A. Voll, Houston, TX (US); Matthew Shane Clews, Perth (AU); Eddie G. Bowen, Porter, TX (US)

(73) Assignee: Baker Hughes Incorporated, Houston, TX (US)

( * ) Notice: Subject to any disclaimer, the term of this patent is extended or adjusted under 35 U.S.C. 154(b) by 358 days.

(21) Appl. No.: 12/497,377

(22) Filed: Jul. 2, 2009

(65) Prior Publication Data

US 2011/0000684 A1 Jan. 6, 2011

(51) Int. Cl.
*E21B 43/12* (2006.01)

(52) U.S. Cl.
CPC ..... *E21B 43/12* (2013.01)
USPC ..... 166/386; 166/205; 166/313; 166/242.3

(58) Field of Classification Search
USPC ..... 166/205, 313, 386, 242.3
See application file for complete search history.

(56) References Cited

U.S. PATENT DOCUMENTS

| | | | | |
|---|---|---|---|---|
| 1,362,552 | A | 12/1920 | Alexander et al. | |
| 1,649,524 | A | 11/1927 | Hammond | |
| 1,915,867 | A | 6/1933 | Penick | |
| 1,984,741 | A | 12/1934 | Harrington | |
| 2,119,563 | A | 3/1937 | Wells | |
| 2,089,477 | A | 8/1937 | Halbert | |
| 2,214,064 | A | 9/1940 | Niles | |
| 2,257,523 | A | 1/1941 | Combs | |
| 2,412,841 | A | 12/1946 | Spangler | |
| 2,762,437 | A | 1/1955 | Egan et al. | |
| 2,810,352 | A | 10/1957 | Tumilson | |
| 2,942,668 | A | 11/1957 | Maly et al. | |
| 2,814,947 | A | 12/1957 | Stegemeier et al. | |
| 2,942,541 | A | 7/1960 | Maly et al. | |
| 3,040,814 | A * | 6/1962 | Daffin | 166/332.5 |

(Continued)

FOREIGN PATENT DOCUMENTS

| | | |
|---|---|---|
| CN | 1385594 | 12/2002 |
| GB | 1492345 | 11/1977 |

(Continued)

OTHER PUBLICATIONS

Optimization of Commingled Production Using Infinitely Variable Inflow Control Valves; M.M, J. J. Naus, Delft University of Technology (DUT), Shell International Exploration and production (SIEP); J.D. Jansen, DUT and SIEP; SPE Annual Technical Conference and Exhibition, Sep. 26-29 Houston, Texas, 2004, Society of Patent Engineers.

(Continued)

*Primary Examiner* — Robert E Fuller
(74) *Attorney, Agent, or Firm* — Mossman, Kumar & Tyler, PC

(57) ABSTRACT

An apparatus and associated method for controlling a flow of a fluid between a wellbore tubular and a formation may utilize a particulate control device positioned external to the wellbore tubular and a flow control device having a retrievable flow restriction element that controls a flow parameter of a fluid flowing between the particulate control device and a bore of the wellbore tubular. The flow control device may be re-configured in the wellbore and/or be used to inject a fluid into the formation.

20 Claims, 3 Drawing Sheets

(56) References Cited

U.S. PATENT DOCUMENTS

| | | | | |
|---|---|---|---|---|
| 3,326,291 | A | 6/1967 | Zandmer | |
| 3,385,367 | A | 5/1968 | Kollsman | |
| 3,419,089 | A | 12/1968 | Venghiattis | |
| 3,451,477 | A | 6/1969 | Kelley | |
| 3,675,714 | A | 7/1972 | Thompson | |
| 3,692,064 | A | 9/1972 | Hohnerlein et al. | |
| 3,739,845 | A | 6/1973 | Berry et al. | |
| 3,791,444 | A | 2/1974 | Hickey | |
| 3,876,471 | A | 4/1975 | Jones | |
| 3,918,523 | A | 11/1975 | Stuber | |
| 3,951,338 | A | 4/1976 | Genna | |
| 3,975,651 | A | 8/1976 | Griffiths | |
| 4,153,757 | A | 5/1979 | Clark, III | |
| 4,173,255 | A | 11/1979 | Kramer | |
| 4,187,909 | A | 2/1980 | Erbstoesser | |
| 4,248,302 | A | 2/1981 | Churchman | |
| 4,250,907 | A | 2/1981 | Struckman et al. | |
| 4,257,650 | A | 3/1981 | Allen | |
| 4,287,952 | A | 9/1981 | Erbstoesser | |
| 4,294,313 | A | 10/1981 | Schwegman | |
| 4,434,849 | A | 3/1984 | Allen | |
| 4,491,186 | A | 1/1985 | Alder | |
| 4,497,714 | A | 2/1985 | Harris | |
| 4,552,218 | A | 11/1985 | Ross et al. | |
| 4,614,303 | A | 9/1986 | Moseley, Jr. et al. | |
| 4,649,996 | A | 3/1987 | Kojicic | |
| 4,974,674 | A | 12/1990 | Wells | |
| 4,998,585 | A | 3/1991 | Newcomer et al. | |
| 5,016,710 | A | 5/1991 | Renard et al. | |
| 5,132,903 | A | 7/1992 | Sinclair | |
| 5,156,811 | A | 10/1992 | White | |
| 5,333,684 | A | 8/1994 | Walter et al. | |
| 5,337,821 | A | 8/1994 | Peterson | |
| 5,431,346 | A | 7/1995 | Sinaisky | |
| 5,435,393 | A | 7/1995 | Brekke et al. | |
| 5,435,395 | A | 7/1995 | Connell | |
| 5,439,966 | A | 8/1995 | Graham et al. | |
| 5,586,213 | A | 12/1996 | Bridges | |
| 5,597,042 | A | 1/1997 | Tubel et al. | |
| 5,609,204 | A | 3/1997 | Rebardi et al. | |
| 5,673,751 | A | 10/1997 | Head et al. | |
| 5,706,891 | A * | 1/1998 | Schraub | 166/51 |
| 5,803,179 | A | 9/1998 | Echols et al. | |
| 5,829,522 | A | 11/1998 | Ross et al. | |
| 5,831,156 | A | 11/1998 | Mullins | |
| 5,839,508 | A | 11/1998 | Tubel et al. | |
| 5,873,410 | A | 2/1999 | Iato et al. | |
| 5,881,809 | A | 3/1999 | Gillespie et al. | |
| 5,896,928 | A | 4/1999 | Coon | |
| 5,982,801 | A | 11/1999 | Deak | |
| 6,068,015 | A | 5/2000 | Pringle | |
| 6,098,020 | A | 8/2000 | Den Boer | |
| 6,112,815 | A | 9/2000 | Boe | |
| 6,112,817 | A | 9/2000 | Voll et al. | |
| 6,119,780 | A | 9/2000 | Christmas | |
| 6,253,847 | B1 | 7/2001 | Stephenson | |
| 6,253,861 | B1 | 7/2001 | Carmichael et al. | |
| 6,273,194 | B1 | 8/2001 | Hiron et al. | |
| 6,305,470 | B1 | 10/2001 | Woie | |
| 6,338,363 | B1 | 1/2002 | Chen et al. | |
| 6,367,547 | B1 | 4/2002 | Towers et al. | |
| 6,371,210 | B1 | 4/2002 | Bode et al. | |
| 6,419,021 | B1 | 7/2002 | George et al. | |
| 6,505,682 | B2 | 1/2003 | Brockman | |
| 6,516,888 | B1 | 2/2003 | Gunnarson et al. | |
| 6,581,682 | B1 | 6/2003 | Parent et al. | |
| 6,622,794 | B2 | 9/2003 | Zisk, Jr. | |
| 6,679,324 | B2 | 1/2004 | Den Boer et al. | |
| 6,786,285 | B2 | 9/2004 | Johnson et al. | |
| 6,817,416 | B2 | 11/2004 | Wilson et al. | |
| 6,840,321 | B2 | 1/2005 | Restarick et al. | |
| 6,857,476 | B2 | 2/2005 | Richards | |
| 6,863,126 | B2 | 3/2005 | McGlothen et al. | |
| 6,938,698 | B2 | 9/2005 | Coronado | |
| 6,951,252 | B2 | 10/2005 | Restarick et al. | |
| 6,976,542 | B2 | 12/2005 | Henriksen et al. | |
| 7,011,076 | B1 | 3/2006 | Weldon et al. | |
| 7,185,706 | B2 | 3/2007 | Freyer | |
| 7,290,606 | B2 | 11/2007 | Coronado et al. | |
| 7,322,412 | B2 | 1/2008 | Badalamenti et al. | |
| 7,325,616 | B2 | 2/2008 | Lopez De Cardenas | |
| 7,395,858 | B2 | 7/2008 | Barbosa et al. | |
| 7,409,999 | B2 | 8/2008 | Henriksen et al. | |
| 7,419,002 | B2 | 9/2008 | Dybevik et al. | |
| 7,469,743 | B2 | 12/2008 | Richards | |
| 7,673,678 | B2 | 3/2010 | MacDougall et al. | |
| 2002/0020527 | A1 | 2/2002 | Kilaas et al. | |
| 2003/0221834 | A1 | 12/2003 | Hess et al. | |
| 2004/0144544 | A1 | 7/2004 | Freyer | |
| 2004/0194971 | A1 | 10/2004 | Thomson | |
| 2005/0016732 | A1 | 1/2005 | Brannon et al. | |
| 2005/0126776 | A1 | 6/2005 | Russell | |
| 2005/0178705 | A1 | 8/2005 | Broyles et al. | |
| 2005/0189119 | A1 | 9/2005 | Gynz-Rekowski | |
| 2005/0199298 | A1 | 9/2005 | Farrington | |
| 2005/0207279 | A1 | 9/2005 | Chemali et al. | |
| 2005/0241835 | A1 | 11/2005 | Burris et al. | |
| 2006/0042798 | A1 | 3/2006 | Badalamenti et al. | |
| 2006/0048936 | A1 | 3/2006 | Fripp et al. | |
| 2006/0048942 | A1 | 3/2006 | Moen et al. | |
| 2006/0076150 | A1 | 4/2006 | Coronado et al. | |
| 2006/0086498 | A1 | 4/2006 | Wetzel et al. | |
| 2006/0108114 | A1 | 5/2006 | Johnson | |
| 2006/0175065 | A1 | 8/2006 | Ross | |
| 2006/0185849 | A1 | 8/2006 | Edwards et al. | |
| 2006/0266524 | A1 | 11/2006 | Dybevik | |
| 2006/0272814 | A1 | 12/2006 | Broome et al. | |
| 2006/0273876 | A1 | 12/2006 | Pachla et al. | |
| 2007/0012444 | A1 | 1/2007 | Horgan et al. | |
| 2007/0039741 | A1 | 2/2007 | Hailey, Jr. | |
| 2007/0044962 | A1 | 3/2007 | Tibbles | |
| 2007/0131434 | A1 | 6/2007 | MacDougall et al. | |
| 2007/0246210 | A1 | 10/2007 | Richards | |
| 2007/0246213 | A1 | 10/2007 | Hailey, Jr. | |
| 2007/0246225 | A1 | 10/2007 | Hailey, Jr. et al. | |
| 2007/0246407 | A1 | 10/2007 | Richards et al. | |
| 2007/0272408 | A1 | 11/2007 | Zazovsky et al. | |
| 2008/0035349 | A1 | 2/2008 | Richard | |
| 2008/0035350 | A1 | 2/2008 | Henriksen | |
| 2008/0053662 | A1 | 3/2008 | Williamson et al. | |
| 2008/0135249 | A1 | 6/2008 | Fripp et al. | |
| 2008/0149323 | A1 | 6/2008 | O'Malley et al. | |
| 2008/0149351 | A1 | 6/2008 | Marya et al. | |
| 2008/0236839 | A1 | 10/2008 | Oddie | |
| 2008/0236843 | A1 | 10/2008 | Scott et al. | |
| 2008/0283238 | A1 | 11/2008 | Richards et al. | |
| 2008/0296023 | A1 | 12/2008 | Willauer | |
| 2008/0314590 | A1 | 12/2008 | Patel | |
| 2009/0065199 | A1 * | 3/2009 | Patel et al. | 166/250.01 |
| 2009/0133869 | A1 | 5/2009 | Clem | |
| 2009/0133874 | A1 | 5/2009 | Dale et al. | |
| 2009/0139727 | A1 | 6/2009 | Tanju et al. | |
| 2009/0205834 | A1 | 8/2009 | Garcia et al. | |

FOREIGN PATENT DOCUMENTS

| | | |
|---|---|---|
| GB | 2341405 | 12/2007 |
| JP | 59089383 | 6/1984 |
| SU | 1335677 A | 9/1987 |
| WO | WO 94/03743 | 2/1994 |
| WO | WO 00/79097 | 5/2000 |
| WO | WO 01/65063 | 2/2001 |
| WO | WO 01/77485 | 3/2001 |
| WO | WO02/75110 | 9/2002 |
| WO | WO2004/018833 A1 | 3/2004 |
| WO | WO2006/015277 | 7/2005 |

OTHER PUBLICATIONS

An Oil Selective Inflow Control System; Rune Freyer, Easy Well Solutions; Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

(56) References Cited

OTHER PUBLICATIONS

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling & Completion, vol. 12, No. 1, March; pp. 13-18; 1997 Society of Petroleum Engineers.

* cited by examiner

FLOW CONTROL DEVICE WITH ONE OR MORE RETRIEVABLE ELEMENTS AND RELATED METHODS

CROSS-REFERENCE TO RELATED APPLICATION

None.

BACKGROUND OF THE DISCLOSURE

1. Field of the Disclosure

The disclosure relates generally to systems and methods for selective control of fluid flow between a wellbore tubular such as a production string and a subterranean formation.

2. Description of the Related Art

Hydrocarbons such as oil and gas are recovered from a subterranean formation using a wellbore drilled into the formation. Such wells are typically completed by placing a casing along the wellbore length and perforating the casing adjacent each such production zone to extract the formation fluids (such as hydrocarbons) into the wellbore. Fluid from each production zone entering the wellbore is drawn into a tubing that runs to the surface. It is desirable to have substantially even drainage along the production zone. Uneven drainage may result in undesirable conditions such as an invasive gas cone or water cone. In the instance of an oil-producing well, for example, a gas cone may cause an in-flow of gas into the wellbore that could significantly reduce oil production. In like fashion, a water cone may cause an in-flow of water into the oil production flow that reduces the amount and quality of the produced oil. Accordingly, it may be desired to provide controlled drainage across a production zone and/or the ability to selectively close off or reduce in-flow within production zones experiencing an undesirable influx of water and/or gas. Additionally, it may be desired to inject a fluid into the formation in order to enhance production rates or drainage patterns.

The present disclosure addresses these and other needs of the prior art.

SUMMARY OF THE DISCLOSURE

In aspects, the present disclosure provides an apparatus for controlling a flow of a fluid between a wellbore tubular and a formation. In one embodiment, the apparatus includes a particulate control device positioned external to the wellbore tubular; and a retrievable flow device element configured to control a flow parameter of a fluid flowing between the particulate control device and a bore of the wellbore tubular.

In further aspects, the present disclosure provides a method of controlling a flow of a fluid between a wellbore tubular and a formation. The method may include positioning a flow control device and a particulate control device in a wellbore that intersects the subsurface formation; adjusting a flow characteristic of the flow control device in the wellbore using a running tool conveyed into the wellbore; conveying a fluid into the wellbore via a wellbore tubular; and injecting the fluid into the particulate control device using the flow control device.

In still another aspect, the present disclosure provides a method for controlling a flow of a fluid between a wellbore tubular and a formation. The method may include injecting a first fluid into the formation using a flow control device; adjusting at least one flow characteristic of the flow control device in the wellbore using a setting device conveyed into the well; and injecting a second fluid into the formation using the flow control device.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE DISCLOSURE

Figure 1:
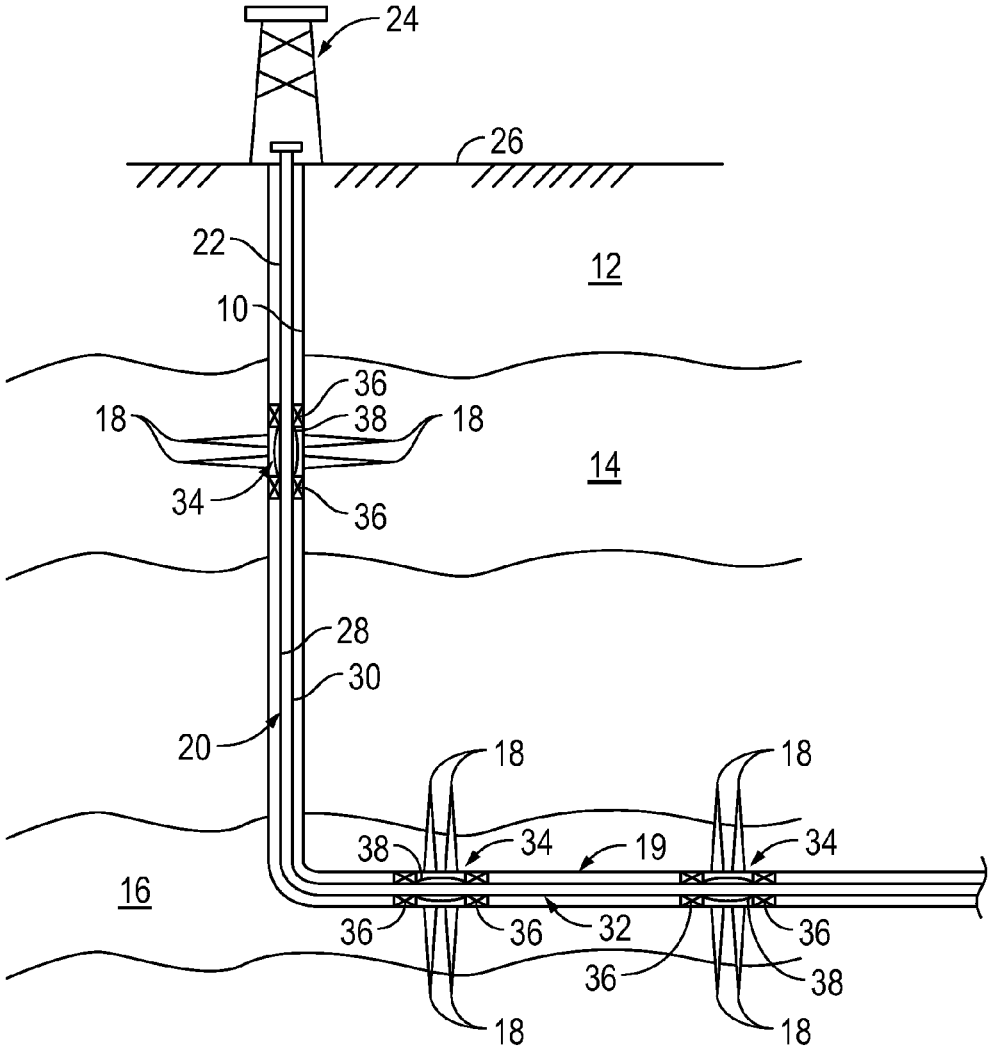
FIG. 1 is a schematic elevation view of an exemplary multi-zonal wellbore and production assembly which incorporates an in-flow control system in accordance with one embodiment of the present disclosure.

The present disclosure relates to devices and methods for controlling a flow of fluid in a well. The present disclosure is susceptible to embodiments of different forms. There are shown in the drawings, and herein will be described in detail, specific embodiments of the present disclosure with the understanding that the present disclosure is to be considered an exemplification of the principles of the disclosure and is not intended to limit the disclosure to that illustrated and described herein.

Referring initially to FIG. 1, there is shown an exemplary wellbore 10 that has been drilled through the earth 12 and into a pair of formations 14, 16 from which it is desired to produce hydrocarbons. The wellbore 10 is cased by metal casing, as is known in the art, and a number of perforations 18 penetrate and extend into the formations 14, 16 so that production fluids may flow from the formations 14, 16 into the wellbore 10. The wellbore 10 has a deviated, or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flowbore 28 along its length. An annulus 30 is defined between the production assembly 20 and the wellbore casing. The production assembly 20 has a deviated, generally horizontal portion 32 that extends along the deviated leg 19 of the wellbore 10. Production devices 34 are positioned at selected points along the production assembly 20. Optionally, each production device 34 is isolated within the wellbore 10 by a pair of packer devices 36. Although only two production devices 34 are shown in FIG. 1, there may, in fact, be a large number of such production devices arranged in serial fashion along the horizontal portion 32.

Each production device 34 features a production control device 38 that is used to govern one or more aspects of a flow of one or more fluids into the production assembly 20. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. Additionally, references to water should be construed to also include water-based fluids; e.g., brine or salt water. In accordance with embodiments of the present disclosure, the production control device 38 may have a number of alternative constructions that ensure selective operation and controlled fluid flow therethrough.

Figure 2:
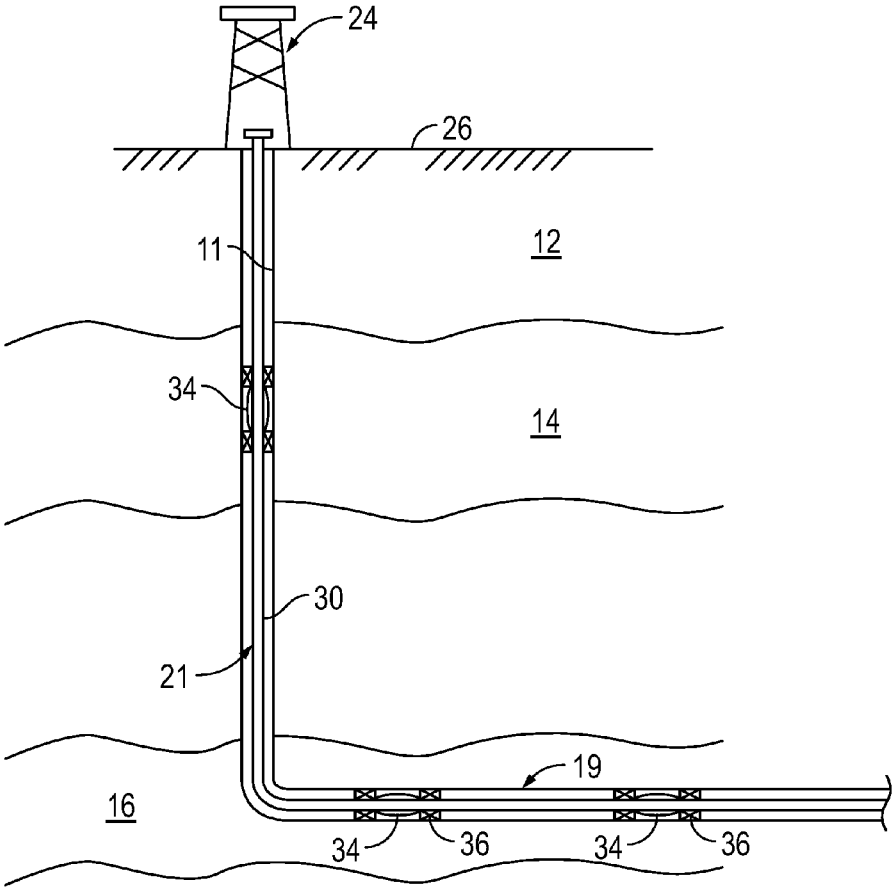
FIG. 2 is a schematic elevation view of an exemplary open hole production assembly which incorporates an in-flow control system in accordance with one embodiment of the present disclosure.

FIG. 2 illustrates an exemplary open hole wellbore arrangement 11 wherein the production devices of the present disclosure may be used. Construction and operation of the open hole wellbore 11 is similar in most respects to the wellbore 10 described previously. However, the wellbore arrangement 11 has an uncased borehole that is directly open to the formations 14, 16. Production fluids, therefore, flow directly from the formations 14, 16, and into the annulus 30 that is defined between the production assembly 21 and the wall of the wellbore 11. There are no perforations, and open hole packers 36 may be used to isolate the production control devices 38. The nature of the production control device is such that the fluid flow is directed from the formation 16 directly to the nearest production device 34, hence resulting in a balanced flow. In some instances, packers maybe omitted from the open hole completion.

Figure 3:
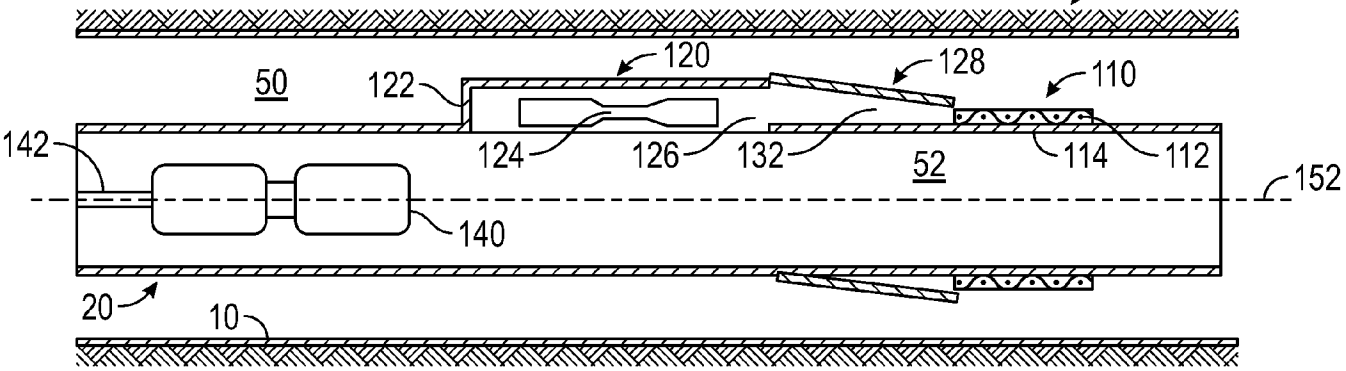
FIG. 3 is a schematic cross-sectional view of an exemplary production control device made in accordance with one embodiment of the present disclosure.

Referring now to FIG. 3, there is shown one embodiment of a production control device 100 for controlling the flow of fluids from a reservoir into a production string, or "in-flow" and/or the control of flow from the production string into the reservoir, or "injection." The control devices 100 can be distributed along a section of a production well to provide fluid control and/or injection at multiple locations. Exemplary production control devices are discussed herein below.

In one embodiment, the production control device 100 includes a particulate control device 110 for reducing the amount and size of particulates entrained in the fluids and a flow control device 120 that controls one or more flow parameters or characteristics relating to fluid flow between an annulus 50 and a flow bore 52 of the production string 20. Exemplary flow parameters or characteristics include but are not limited to, flow direction, flow rate, pressure differential, degree of laminar flow or turbulent flow, etc. The particulate control device 110 can include a membrane that is fluid permeable but impermeable by particulates. Illustrative devices may include, but are not limited to, a wire wrap, sintered beads, sand screens and associated gravel packs, etc. In one arrangement, a wire mesh 112 may be wrapped around an unperforated base pipe 114.

In embodiments, the flow control device 120 is positioned axially adjacent to the particulate control device 100 and may include a housing 122 configured to receive a flow restriction element 124. The housing 122 may be formed as a tubular member having a radially offset pocket 126 that is shaped to receive the flow restriction element 124. The pocket 126 may be an interior space that provides a path for fluid communication between the annulus 50 of the wellbore 10 and the flow bore 52 of the production assembly 20. In one arrangement, the housing 122 may include a skirt portion 128 that channels fluid between the pocket 126 and the particulate control device 110. For example, the skirt portion 128 may be a ring or sleeve that forms an annular flow path 132 around the base pipe 114. In one arrangement, the fluid may flow substantially axially through the particulate control device 112, the flow path 132, and the flow restriction element 124.

In embodiments, the flow restriction element 124 may be a device configured to provide a specified local flow rate under one or more given conditions (e.g., flow rate, fluid viscosity, etc.). For injection operations, the flow restriction element 124 may provide a specified local fluid injection rate, or range of injection rates, for a given pressure differential or surface injection fluid pump rate. The flow restriction element 124 may be formed to be inserted into and retrieved from the pocket 126 in situ, i.e., after the production control device 100 has been positioned in the wellbore. By in situ, it is meant a location in the wellbore. Insertion and/or extraction of the flow restriction element 124 may be performed by a running tool 140, which may be generally referred to as kickover tools. A suitable carrier 142, such as a wireline or coiled tubing, may be used to convey the running tool 140 along the flow bore 52.

Exemplary flow restriction elements 124 may include, but are not limited to, valves, choke valves, orifice plates, devices utilizing tortuous flow paths, etc. The flow restriction element 124 may be removable. Thus, the flow restriction element 124 may include a plurality of interchangeable or modular elements. For instance, a first modular element may completely block flow, a second element may partially block flow, and a third element may allow full flow. Also, full flow may be achieved by simply removing the flow restriction element 124. Thus, certain embodiments may provide a variable flow rate; i.e., a flow rate that may vary from zero to maximum flow and any intermediate flow rate. In some embodiments, the flow restriction element 124 remains in place in the flow control device 120 and includes a plurality of different flow paths, each of which provide a different flow characteristic. For instance, the flow restriction element 124 may be a disk having a plurality of differently sized orifices. The disk may be rotated to align a specific orifice with a flow path.

Illustrative side pocket mandrels, running tools, and associated flow control elements are described in U.S. Pat. Nos. 3,891,032, 3,741,299; 4,031,955, which are hereby incorporated by reference for all purposes.

It should be understood that the flow control device 120 is susceptible to a variety of configurations, of which the use of a radially offset pocket 126 is one non-limiting example. For example, the flow restriction element 124 may be positioned within the flow bore 52. Moreover, the flow control device 120 may be integral with the production assembly 20 or a modular or self-contained component.

Referring generally to FIGS. 1-3, in one mode of deployment, the reservoirs 14 and 16 may be characterized via suitable testing and known reservoir engineering techniques to estimate or establish desirable fluid flux or drainage patterns. The desired pattern(s) may be obtained by suitably adjusting the flow control devices 120 to generate a specified pressure drop. The pressure drop may be the same or different for each of the flow control devices 120 positioned along the production assembly 20. Prior to insertion into the wellbore 10, formation evaluation information, such as formation pressure, temperature, fluid composition, wellbore geometry and the like, may be used to estimate a desired pressure drop for each flow restriction device 120. The flow control elements 124 for each device may be selected based on such estimations and underlying analyses.

During a production mode of operation, fluid from the formation 14, 16 flows into the particulate control device 110 and then axially through the skirt portion 128 into the flow control device 120. As the fluid flows through the pocket 126, the flow restriction element 124 generates a pressure drop that results in a reduction of the velocity of the flowing fluid. It should be appreciated that the fluid flow is generally aligned with the long axis 152 of the flow bore. That is, substantial fluid flow lateral to the longitudinal axis of the flow bore occurs only upstream or down stream of the flow restriction element 124. Thus, lateral fluid flow does not occur at the location of the generated pressure drop in the fluid.

In an injection mode of operation, a particular section or location in a formation is selected or targeted to be infused or treated with a fluid. The injection mode may include selecting a predetermined distance for penetration of the fluid into the formation. During operation, the fluid is pumped through the production assembly 20 and across the production control device 100. As the fluid flows through the flow restriction elements 124, a pressure drop is generated that results in a reduction of the flow velocity of the fluid flowing through the particulate control device 110 and into the annulus 50 (FIG. 3). Again, fluid flow is generally aligned with the axis of the flow bore or base pipe. The fluid may be sufficiently pressurized to penetrate the formation. For instance, the fluid may be pressurized to a pressure that is higher than a pore pressure of the formation to flow into the formation a predetermined or desired distance. Also, the fluid may be pressurized to a pressure that is higher than a fracture pressure of the formation to generate fracturing in the formation to improve or enhance formation permeability. Thus, the fluid injected into the formation may perform any number of functions. For instance, the fluid may be a fracturing fluid that increases the permeability of the formation by inducing fractures in the formation. The fluid may also include proppants that keep fracture or tunnels open to fluid flow. The fluids may also adjust one or more material or chemical properties of the formation and/the fluids in the formation. The fluids may also introduce thermal energy (e.g., steam) to increase the mobility of fluids in the formation or form water fronts that push or otherwise cause hydrocarbon deposits to migrate or move in a desired manner. The fluids may be substantially a liquid, substantially a gas, or a mixture. By substantially, it is meant more than about fifty percent in volume.

Figure 4:
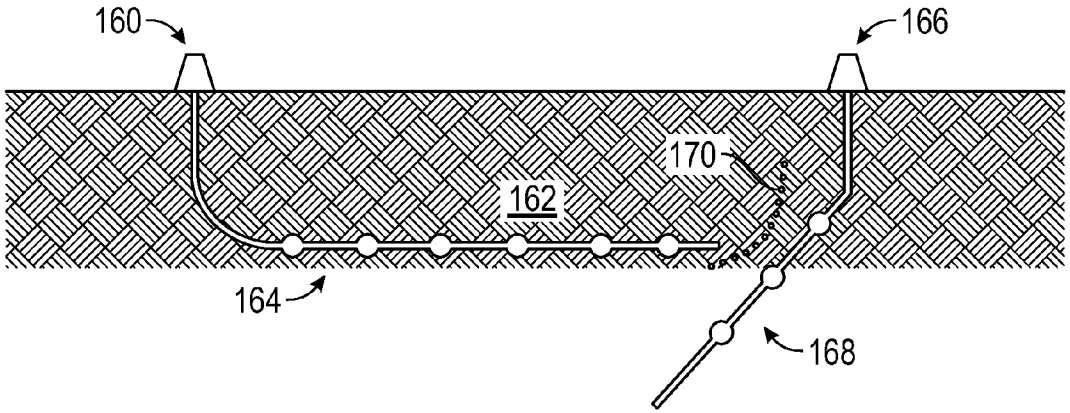
FIG. 4 is a schematic elevation view of exemplary production control devices made in accordance with one embodiment of the present disclosure that are used in two or more wells.

The injection modes may be utilized in several variants. In one variant, a production control device 100 may be used to both drain fluid from a formation and inject fluid into a formation. Thus, for instance, the production string 22 of FIG. 1 may be used for both injection and production. Referring now to FIG. 4, two or more wells may be used for production of hydrocarbons. A first well 160 may be used to produce fluids from a formation 162 via a plurality of production devices 164 and a second well 166 may be used to inject fluids into the formation 162 via one or more production devices 168. For instance, a fluid such as water or brine may be injected via the production devices 168 to form a water front 170 that enhances production from the first well 160.

It should be understood that the production and injection modes are merely illustrative and the present disclosure is not limited to any particular operating mode.

Numerous methodologies may be employed in the installation of the production control devices 100 in the well. In one embodiment, reservoir models, historical models, and/or other information may be used to estimate or establish desired injection rates for one or more production control devices 100. Illustrative injection regimes for one or more production devices 100 may include a minimum injection rate, a uniform injection rate, injection rates that vary according to the physical location (e.g., a "heel" of the well, a "toe" or terminal end of the well, etc.), etc. In one arrangement, the flow restriction element 124 of each flow control device 120 is installed at the surface and the production string is thereafter installed in the well.

In other arrangements, the local injection rates along the production string are configured after the tubing string 22 is installed in the well. This configuration may be controlled by personnel at the surface. For example, a "dummy" flow control element that blocks flow across a pocket 126 may be installed in one or more of the production control devices 100. After the production string 20 is set in the wellbore, personnel may convey the running tool 140 into the wellbore to retrieve the "dummy" flow control element and install an operational flow control element that provides a specified injection behavior. In arrangements, well tests may be performed before or after the "dummy" flow control element is removed in order to select a flow control element having the appropriate flow characteristics.

In still other arrangements, the local injection rates along the tubing string 22 may be re-configured after the tubing string 22 is installed in the well. For example, changes in local reservoir parameter or conditions may necessitate a change in an injection rate for one or more production control devices 100. In such situations, the running tool 140 may be conveyed into the wellbore to retrieve an operational flow control element having one injection behavior and thereafter install another flow control element that provides a different injection behavior. The newly installed flow control element may be a "dummy" flow control element. Thus, the configuration process may be initiated or otherwise controlled from the surface.

From the above, it should be appreciated that what has been described includes, in part, an apparatus for controlling a flow of a fluid between a wellbore tubular and a formation. In one embodiment, the apparatus includes a particulate control device positioned external to the wellbore tubular; and a retrievable flow control element that controls a flow parameter of a fluid flowing between the particulate control device and a bore of the wellbore tubular. A housing having an interior space may receive the flow control element. The interior space may form a flow path that is aligned with a longitudinal axis of the wellbore tubular. In certain implementations, the flow control element may flow substantially a liquid.

From the above, it should be appreciated that what has been described also includes, in part, a method of controlling a flow of a fluid between a wellbore tubular and a formation. The method may include positioning a flow control device and a particulate control device in a wellbore that intersects the subsurface formation; adjusting a flow characteristic of the flow control device in the wellbore using a running tool conveyed into the wellbore; conveying a fluid into the wellbore via a wellbore tubular; and injecting the fluid into the particulate control device using the flow control element. In one arrangement, the method may include pressurizing the fluid such that the fluid penetrates a predetermined distance into a formation. Also, the fluid may be substantially a liquid. One illustrative fluid may be a fracturing liquid engineered to change a permeability of the formation.

In implementations, the method may include generating a water front in the formation using the fluid. The method may further include controlling the at least one flow characteristic using a flow control element associated with the flow control device; and replacing the flow control element to adjust the at least one flow characteristic. Additionally, the method may include: retrieving the flow control element; installing a second flow control element in the wellbore, the second flow control element having at least one flow characteristic that is different from the retrieved flow control element; and injecting a fluid into the formation using the second flow control element. In arrangements, the method may include flowing a reservoir fluid through the flow control element. In other arrangements, the method may include positioning a plurality of flow control devices and associated particulate control devices in the wellbore; and equalizing a flux of produced fluids along at least a portion of the wellbore by adjusting a flow characteristic of at least one flow control device of the plurality of flow control devices using a running tool conveyed into the wellbore.

From the above, it should be appreciated that what has been described further includes, in part, a method for controlling a flow of a fluid between a wellbore tubular and a formation. The method may include injecting a first fluid into the formation using a flow control device; adjusting at least one flow characteristic of the flow control device in situ using a setting device conveyed into the well; and injecting a second fluid into the formation using the flow control device. In embodiments, the method may include flowing a reservoir fluid through the flow control element. The method may also include increasing a permeability of the formation using at least one of: (i) the first fluid, and (ii) the second fluid. The method may also include generating a water front in the formation using the fluid and/or equalizing a flux of produced fluids along at least a portion of the wellbore by adjusting the at least one flow characteristic.

It should be understood that FIGS. 1 and 2 are intended to be merely illustrative of the production systems in which the teachings of the present disclosure may be applied. For example, in certain production systems, the wellbores 10, 11 may utilize only a casing or liner to convey production fluids to the surface. The teachings of the present disclosure may be applied to control the flow into those and other wellbore tubulars.

For the sake of clarity and brevity, descriptions of most threaded connections between tubular elements, elastomeric seals, such as o-rings, and other well-understood techniques are omitted in the above description. Further, terms such as "valve" are used in their broadest meaning and are not limited to any particular type or configuration. The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

What is claimed is:

1. An apparatus for controlling a flow of a fluid between a production string and a formation, comprising:

a base pipe associated with the production string, the production string having a flow bore aligned with a longitudinal axis of the production string;

a particulate control device wrapped around and contacting an unperforated portion of the base pipe, the fluid flowing substantially axially through the particulate control device in a direction aligned with the flow bore of the production string, the particulate control device reducing an amount and size of particles in the fluid; and a flow control device axially adjacent to the particulate control device, the flow control device including a retrievable flow restriction element in fluid communication with the particulate control device, the retrievable flow restriction element being positioned in a pocket radially offset from the flow bore and configured to control a flow parameter of the fluid flowing between the particulate control device and the flow bore of the production string, wherein the flow restriction element is configured to be retrieved through the flow bore of the production string.

2. The apparatus according to claim 1, wherein the pocket defines an interior space configured to receive the flow restriction element, and further comprising a running tool configured to retrieve the flow restriction element from the interior space.

3. The apparatus according to claim 2 wherein the interior space forms a flow path that is aligned with the longitudinal axis of the production string such that the fluid flows axially from the particulate control device into the flow control device.

4. The apparatus according to claim 1, wherein the flow restriction element is configured to flow substantially a liquid.

5. The apparatus according to claim 1, wherein the particulate control device is positioned to reduce the amount and size of the particles as the fluid flows axially through the particulate control device.

6. The apparatus according to claim 1, wherein the particulate control device is one of: (i) a permeable membrane, (ii) a wire wrap, (iii) sintered beads, (iv) a wire mesh, and (v) a sand screen.

7. A method of controlling a flow of a fluid between a production string and a formation, comprising:

positioning the production string in a wellbore intersecting the formation, the production string having a flow bore aligned with a longitudinal axis of the production string, the production string further comprising a flow control device and a particulate control device, the flow control device being axially adjacent to the particulate control device, the particulate control device wrapped around and contacting an unperforated portion of a base pipe of the production string;

positioning a flow restriction element in the flow control device in a pocket radially offset from the flow bore of the production string, wherein the flow restriction element is retrievable through the flow bore of the production string;

adjusting a flow characteristic of the flow control device positioned in the wellbore using a running tool conveyed into the wellbore;

conveying a fluid into the wellbore via the production string; and injecting the fluid into the particulate control device using the flow restriction element, the fluid entering the particulate control device in an axial direction.

8. The method according to claim 7 pressurizing the fluid such that the fluid penetrates a predetermined distance into a formation.

9. The method according to claim 7 wherein the fluid is substantially a liquid.

10. The method according to claim 7 wherein the fluid includes a fracturing liquid engineered to change a permeability of the formation.

11. The method according to claim 7 further comprising generating a water front in the formation using the fluid.

12. The method according to claim 7 further comprising controlling the at least one flow characteristic using the flow restriction element; and retrieving the flow restriction element.

13. The method according to claim 12, further comprising: installing a second flow restriction element in the wellbore, the second flow restriction element having at least one flow characteristic that is different from the retrieved flow control element; and injecting a second fluid into the formation using the second flow restriction element.

14. The method according to claim 7 further comprising flowing a reservoir fluid through the flow restriction element.

15. The method according to claim 7 further comprising positioning a plurality of flow control devices and associated particulate control devices in the wellbore; and equalizing a flux of produced fluids along at least a portion of the wellbore by adjusting a flow characteristic of at least one flow control device of the plurality of flow control devices using a running tool conveyed into the wellbore.

16. A method for controlling a flow of a fluid between a production string and a formation, the production string having a flow bore aligned with a longitudinal axis of the production string, the method comprising:

injecting a first fluid into the formation using a flow control device positioned in the wellbore, the flow control device having a flow restriction element positioned in a pocket radially offset from the flow bore of the production string and axially adjacent to a particulate control device wrapped around and contacting an unperforated portion of a base pipe of the production string, the first fluid entering the particulate control device in a direction aligned with the flow bore;

adjusting at least one flow characteristic of the flow control device positioned in the wellbore using a setting device conveyed into the well; and injecting a second fluid into the formation using the flow control device.

17. The method according to claim 16 further comprising flowing a reservoir fluid through the flow restriction element.

18. The method according to claim 16 further comprising increasing a permeability of the formation using at least one of: (i) the first fluid, and (ii) the second fluid.

19. The method according to claim 16 further comprising generating a water front in the formation using the fluid.

20. The method according to claim 16 further comprising equalizing a flux of produced fluids along at least a portion of the wellbore by adjusting the at least one flow characteristic.

* * * * *